US007222633B1

(12) United States Patent
Werner, III

(10) Patent No.: US 7,222,633 B1
(45) Date of Patent: May 29, 2007

(54) ERGONOMIC SUPPORT STAFF APPARATUS

(76) Inventor: Philip Henry Werner, III, 2707 Gillis Rd., Mount Airy, MD (US) 21771

( * ) Notice: Subject to any disclaimer, the term of this patent is extended or adjusted under 35 U.S.C. 154(b) by 12 days.

(21) Appl. No.: 11/159,246

(22) Filed: Jun. 23, 2005

(51) Int. Cl.
*A45B 1/00* (2006.01)

(52) U.S. Cl. ..... 135/65

(58) Field of Classification Search ..... 135/66, 135/68, 69, 72, 73, 75, 76, 71, 64; 280/11, 280/819, 820
See application file for complete search history.

(56) References Cited

U.S. PATENT DOCUMENTS 2,960,095 A * 11/1960 Smith, Jr. ..... 135/68
3,304,946 A * 2/1967 Lutes ..... 135/69
5,287,870 A * 2/1994 Rhodes ..... 135/72
5,482,070 A * 1/1996 Kelly ..... 135/66
5,566,700 A * 10/1996 Brown ..... 135/72
5,711,334 A * 1/1998 Roux ..... 135/65
5,755,644 A * 5/1998 Breems ..... 482/67
5,771,910 A * 6/1998 Kluttz ..... 135/68
5,845,664 A * 12/1998 Ryder et al. ..... 135/65
5,924,434 A * 7/1999 Cato, III ..... 135/68

* cited by examiner

*Primary Examiner*—David R. Dunn
*Assistant Examiner*—Noah Chandler Hawk
(74) *Attorney, Agent, or Firm*—Rosenberg, Klein & Lee

(57) ABSTRACT

An ergonomic support staff apparatus for supporting a user upon a surface is provided. The apparatus generally includes a longitudinally extended support member having upper and lower portions, and an intermediate shaft portion extending therebetween. The apparatus also includes a handle member coupled to at least one of the upper and intermediate shaft portions of the support member. The handle member protrudes laterally outward from the support member to define an angled grip portion disposed to extend in inclined manner relative to the support member. Use of the apparatus thereby enables the range of requisite arm swing motion for manipulation of the support member into stable engagement of the given surface to be minimized.

20 Claims, 3 Drawing Sheets

3
10
4
2

22
12a
20
21
10'
30
12b
11
16
13
14

50a
50b
55
50c
10"
12a
50d
30
16

14

12a

55'
50'
12b 30c
34a
30c
30b
30'
32
11'
34b
30a
34c
36
35

14'

ERGONOMIC SUPPORT STAFF APPARATUS

BACKGROUND OF THE INVENTION

FIELD OF THE INVENTION

The present invention is directed to an apparatus for supportively assisting a user to maintain balance and stability while engaged in various activities. The apparatus facilitates the natural bodily motions of a user while performing the necessary movements, for example, in walking and in generating propulsion during skiing. Incorporating the ergonomics of natural body movement, the apparatus allows for extended use with less fatigue.

The present invention finds numerous applications. In one exemplary application, the apparatus may form an emergency crutch, which allows for easier movement over rugged terrain. Other applications include a walking stick device, a cane for orthopedic recreational use, and an adjustable handle for ski poles. The invention incorporates an improved gripping system for all of these illustratively noted applications.

Walking sticks and canes are and have been used from virtually the beginning of time. The subject support staff apparatus does what man has attempted to accomplish since then. The apparatus provides for optimal functional assistance to the natural movements of the body when walking, whether in a natural or impaired condition. Holding one or more of these devices, the user is able to steady the walking function and relieve the stress/impact on the foot/feet.

Ski poles are a part of ski equipment used in both competition and recreation to maneuver during downhill and cross country skiing. The purpose of the pole is to provide balance, aid in turning and braking maneuvers, and to enable propulsive action by the user. Using in each hand a pole formed in accordance with the present invention, the user will experience increased maneuverability with the enhanced ergonomic effect provided at least in part by the reverse grip of the handle.

SUMMARY OF THE INVENTION

An object of the present invention is to provide a support apparatus which may be utilized in various applications as a walking stick, cane, crutch, ski pole and the like.

It is another object of the present invention to provide a support apparatus which incorporates a grip that takes advantage of the natural posture of the user's hand and arm in an ergonomic movement relationship, to require less effort and strain on the upper body during use.

These and other objects are attained in an ergonomic support staff apparatus formed in accordance with the present invention for supporting a user upon a surface. The apparatus generally includes a longitudinally extended support member having upper and lower portions, and an intermediate shaft portion extending therebetween. The apparatus also includes a handle member coupled to at least one of the upper and intermediate shaft portions of the support member. The handle member protrudes laterally outward from the support member to define an angled grip portion disposed to extend in inclined manner relative to the support member. Use of the apparatus thereby enables the range of requisite arm swing motion for manipulation of the support member into stable engagement of the given surface to be minimized.

In certain exemplary embodiments of the present invention, the ergonomic support staff apparatus includes the handle member integrally formed with said support member. In other exemplary embodiments, the apparatus is formed with handle member adjustably coupled to the support member.

BRIEF DESCRIPTION OF THE DRAWINGS

In the following description, given by way of example, reference is made to the appended drawings, wherein.

DETAILED DESCRIPTION OF THE PREFERRED EMBODIMENTS

Typical applications of the present invention relate to an orthopedic recreational walking-stick, crutch-cane for emergency use, and an adjustable handle application for ski poles.

In typical walking stick applications of the present invention, a walking stick may be advantageously provided in which both the user's heel and the walking stick base preferably make contact simultaneously with the walk surface, allowing for reduced impact on the user's foot. The handle forms an ergonomic structure which allows for the natural (arc) pivoting of the arm from the shoulder during use, while the user applies a pulling force to the grip of the walking stick. As the present invention provides for various recreational and orthopedic uses, a foot wounded, leg wounded, or handicapped person may be enabled to ambulate substantially as usual with one such walking stick, and to remain more easily in a standing position by keeping his or her balance, while still having in such a position free use of an upper limb.

In certain embodiments particularly well-suited for orthopedic uses, an apparatus formed in accordance with the present invention may assist an injured or handicapped person to move more effortlessly about, serving as a crutch or cane. In other embodiments, the apparatus may preferably be adapted for particular use by adjustably reversing the direction of an auxiliary handle attachment. By redirecting the position of the cane handle attachment, the cane is effectively turned into a two handed cane for use when rising from a sitting position to a standing position. In a walking configuration, the cane provides two handed steadiness by permitting the use of two handles substantially at one junction for grasping.

In still other embodiments, the apparatus may be formed as a ski pole, with the handle serving as an ergonomic device which allows for natural (arc) pivoting of the arm from the shoulder when the user applies a pulling force to the grip of the pole.

Figure 1A:
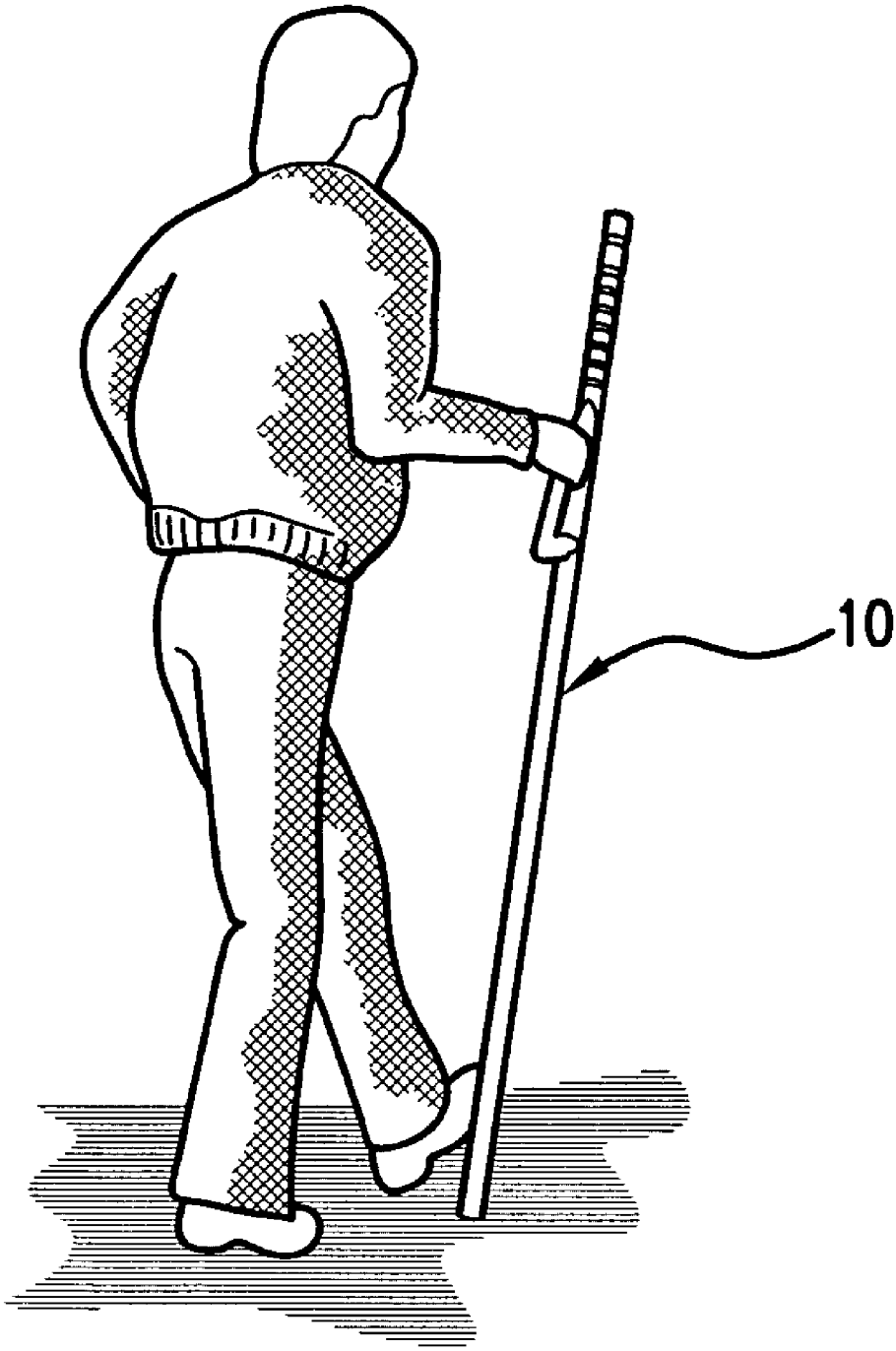
FIG. 1*a* is a schematic perspective view illustrating a typical use of one exemplary embodiment of the present invention.
Figures 1B, 1C, 2, 3, 3A, 4, 4A, 4B:
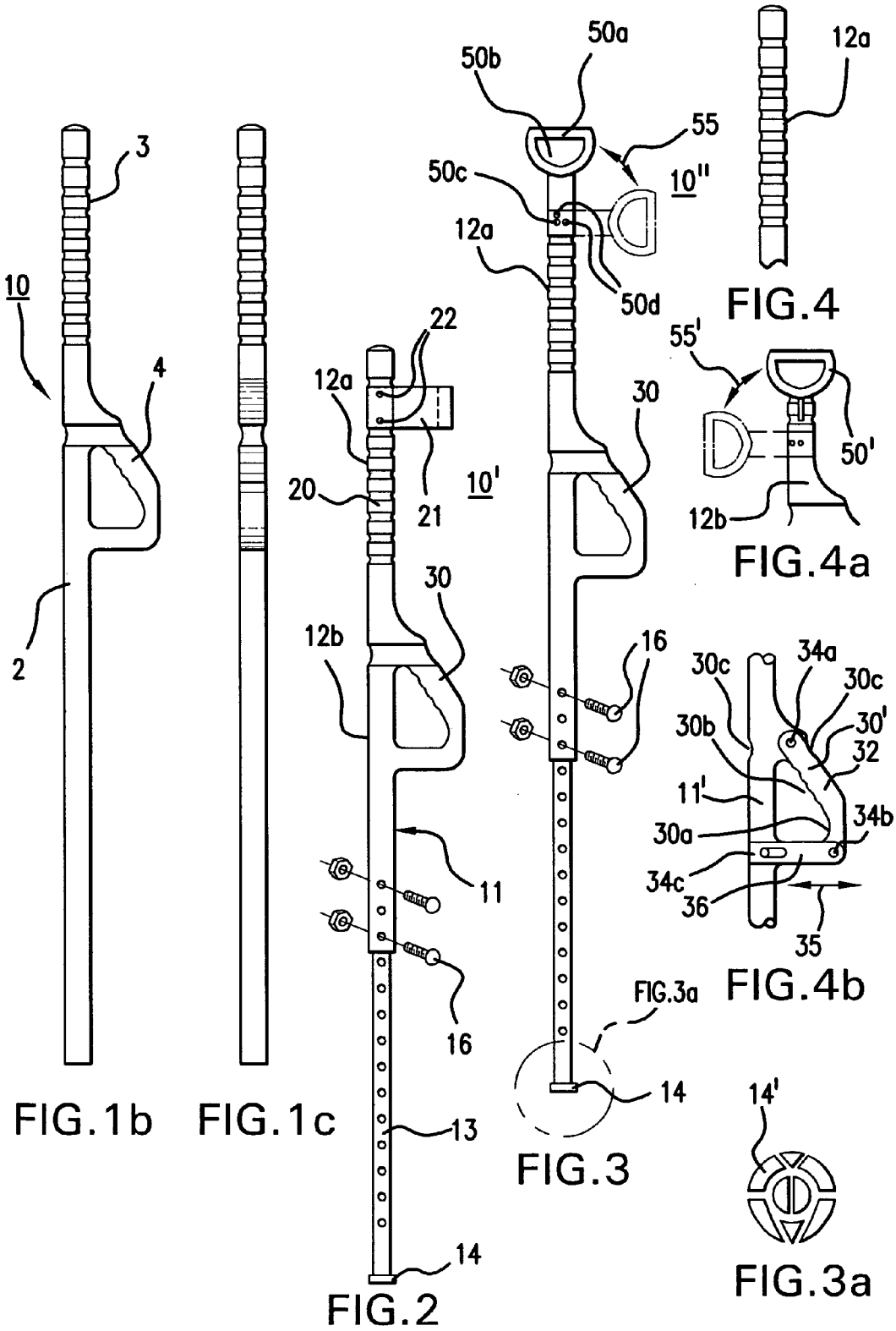
FIG. 1*b* is a side elevational view of the exemplary embodiment of the present invention shown in FIG. 1*a;*
FIG. 1*c* is a rear elevational view of the exemplary embodiment of the present invention shown in FIG. 1*a;*
FIG. 2 is a partially exploded side elevational view of an alternate embodiment of the present invention.
FIG. 3 is a partially exploded side elevational view of another alternate embodiment of the present invention.
FIG. 3*a* is a detailed bottom plan view of a portion of the exemplary embodiment shown in FIG. 3, illustrating an exemplary tread pattern for a base tip.
FIG. 4 is a cut away isolated side elevational view of an upper portion of a support member in the exemplary embodiment shown in FIG. 1*b;*
FIG. 4*a* is a cut away isolated side elevational view of a portion of another alternate embodiment of the present invention.
FIG. 4*b* is a cut away isolated side elevational view of a portion of a handle member in still another alternate embodiment of the present invention.

Referring now to FIGS. 1*a*–1*c*, there is illustratively shown one exemplary embodiment of the present invention suitable for use as an orthopedic walking stick, crutch, or cane. In this embodiment, the staff-like apparatus is integrally formed, with a support member 2 having an elongate intermediate shaft extending between upper and lower ends. A grooved handle 3 is preferably formed at the upper end, and a grip handle member 4 is positioned at the intermediate shaft portion.

The entire grip and pole may be constructed from a variety of materials currently known in the art and used in the construction of recreation equipment. Due to the use of various construction materials in the various applications illustratively described herein as well as in additional applications, those skilled in the art will recognize that certain particular features of given embodiments may suitably vary, without departing substantially from the functionality as defined herein.

Referring to FIG. 2, there is shown an alternate embodiment of the present invention which is similar to that illustrated in FIGS. 1*a*–1*c*, but is adjustably configured to serve as an orthopedic walking-stick particularly well-suited for emergency use. The stick 10' in this embodiment comprises a standard or body 11 formed collectively by a combination of a handle section 12*a* extending from a tube 12*b* to which is telescopically coupled an end section 13 fitted with a rubber foot 14. Preferably, the length of the standard, or support member body 11, may be adjustably locked in the desired configuration by means of one or more knurled knobs (not shown) or bolts 16 fitting into pre-drilled holes.

The upper part of the walking stick handle 20 in this embodiment is provided with a crutch extension part 21 which, having a lined or unlined retainer for the support of the forearm, is attached by clamping screws 22 secured thereto, or by any other suitable means known in the art. This crutch extension feature is configured and situated such that it may be easily discarded from use by the user simply folding his or her lower arm inward, should he/she become unstable. That is, the crutch extension part 21 naturally releases and falls away from the user's arm responsive to the lower end of the support member body 11 swinging upward with the user's hand (gripping the grip handle member), thereby freeing the user's arm from unwanted restraint.

The main grip handle section 30 may advantageously function as a part of the walking stick, cane, or the like formed by the apparatus 10'. The grip portion of this section 30 is preferably inclined at an angle ranging substantially between 33 and 45 degrees from vertical.

FIG. 3 illustrates another alternate embodiment of the present invention. This embodiment is a similar to the two preceding embodiments particularly suitable for cane/walking stick applications. In this embodiment, an upper portion of the apparatus 10" is provided with a shaft fitting into the main body above the staff handle, with a grooved shovel style handle extension 50*a* coupled to terminate the staff handle section 12*a*. Between the coupling or attachment point and end of the shovel style handle 50*a* there is defined a grooved section 50*b* for firm, secure gripping. This section of the handle may be moved from side to side, as indicated by the direction arrow 55, by the means of a pinned hinge 50*c* and a tightening lug or knob 50*d*.

Preferably, the shovel style handle 50*a* may also be moved about the axis of the staff handle section 12*a*, by 360 degrees for example, to facilitate two handed grasping at any angle combination. Such turning of the shovel style handle may be facilitated by means of any suitable tightening knob (not shown). This allows for quick adjustment into various positions for two handed control and stability when walking, and/or when rising from or lowering into a sitting position.

FIG. 3*a* illustrates in greater detail an example of numerous tread patterns that may be suitably formed at the bottom of the gripping tip 14. In the example shown, the tread surface defines a direction indicating gripping tip 14' which not only serves to enhance traction, but also tends to leave an arrow-like directional imprint on the underlying surface. This may prove helpful should the need arise to later track the user's path of travel.

Turning to FIGS. 4–4*b*, there are shown examples of various structural configurations which may be employed in accordance with still other alternate embodiments of the present invention. In FIG. 4, an isolated view of the upper or staff handle 12*a* having a ribbed configuration of the type employed in the embodiment of FIGS. 1*a*–1*c* is shown. In FIG. 4*a*, a shovel style handle 50' much like that illustrated in the embodiment of FIG. 3 is shown coupled directly to an intermediate portion 12*b* of the given staff or support member. As in the embodiment of FIG. 3, this shovel style handle 50' is preferably coupled for pivotal displacement as indicated, for example, by the directional arrow 55'.

In FIG. 4*b*, the main grip handle member 30' is shown in an exemplary adjustable configuration. Preferably, the inclined handle portion 32 of the grip member 30' is pivotally coupled by a pin 34*a* at its juncture with the staff member 11'. The handle portion 32 is preferably also pivotally coupled by a pin 34*b* to a lateral portion 36 which is in turn slotted pin coupled to the staff member 11' (as shown at 34*c*) to form a pinned hinged slide coupling therewith. This enables slidable adjustment, as indicated by the directional arrow 35, to accommodate the handle portion's angular adjustment. Once adjusted to the desired position, the coupling is preferably secured by means of one or more counter sunk bolts, pins, or clamping brackets of any suitable type known in the art.

Preferably, the handle portion 32 is formed with one large finger groove 30*a* and four normal finger grooves 30*b*. At the juncture of the grip member 30 and the vertical stick, or staff member 11', two wide shallow grooves 30*c* are preferably formed for placement of the forefinger and thumb as an alternative grasping position.

Each of the preceding embodiments shown preferably include such grooving to extends endlessly around the juncture of the intermediate and upper handle portions of the support or staff member. This grooving allows comfortable fit between thumb and forefinger. The handle may have any additional grooves formed therein to suitably accommodate the user.

Figure 5:
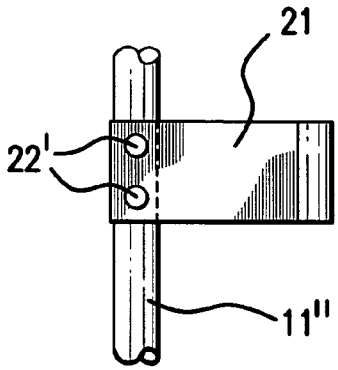
FIG. 5 is a cut away isolated side elevational view illustrating a portion of an additional alternate embodiment of the present invention.
Figure 5A:
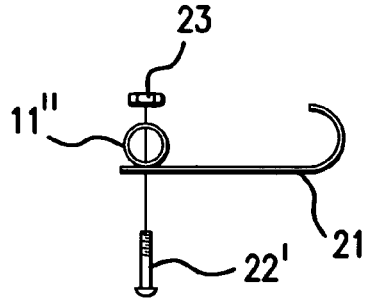
FIG. 5*a* is a partially exploded top plan view of the portion of the exemplary embodiment shown in FIG. 5; and, FIG. 6 is a schematic perspective view illustrating a typical use of yet another alternate embodiment of the present invention.

FIGS. 5 and 5*a* illustrate the arm cradling part 21 of the crutch embodiment, such as shown in FIG. 2, being attached to any suitable portion of the given staff member 11". The part 21 is attached in this embodiment by clamping bolts 22' secured by corresponding nuts 23.

Figure 6:
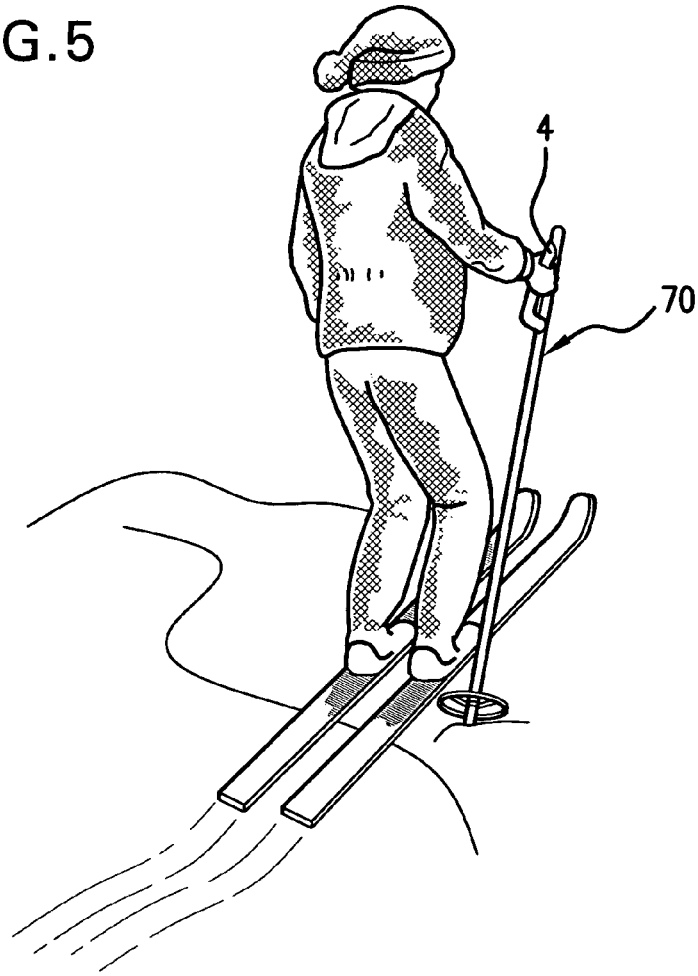

FIG. 6, there is illustratively shown an alternate embodiment of the present invention suitable for use as an orthopedic ski pole. In this embodiment, a grip handle member 4 is formed much as described in preceding paragraphs onto a support member configured as a ski pole terminated at its bottom by a pointed ski pole tip. This embodiment allows for the described ergonomic-grip-pulling motion, with each arm moving in a natural arc, to ease the user's self-propelling and maneuvering actions during skiing.

Briefly, use of the subject apparatus as a walking stick, a cane, or a ski pole, for example, advantageously allows for a natural movement of the user's arm, which in turn allows for a natural pulling movement from the wrist. Such use puts less stress on the user's arm than comparable devices heretofore known in the art. As a walking stick or crutch, the apparatus among other things aids in reducing impact upon an injured foot when walking, allowing the user's arm to absorb some of the weight of impact. This may be accomplished by allowing the walking stick/cane to impact the walking surface at the same time the foot strikes the walking surface.

The walking stick/cane embodiment also allows for several emergency field uses with the addition of attachments. These attachments, for instance, allow the user to convert the walking stick into an emergency crutch to assist in walking with a disabled foot or leg.

When implemented in ski poles, the subject apparatus allows for primarily a pulling motion of the arm instead of a pushing motion. Use of the angled grip handle allows for greater force to be applied to the poles in this manner for propulsion, as it effectively increases the leverage and resulting force that may be applied to the snow surface underneath.

An overall effect of the force applied by use of the subject apparatus, for propulsion and for shock reduction, is more efficient use of natural body leverage. The apparatus takes fuller advantage of the user's upper body strength and natural swing movement of the entire arm. Another effect is to reduce the required stress on lower arms and wrists, by taking advantage of the natural movement and alignment of the arm.

Additional components and features of the walking stick/cane and ski pole described in the Detailed Description may be included to enhance performance or flexibility of use.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular features may be reversed or interposed, all without departing from the spirit or scope of the invention as defined in the appended claims.

What is claimed is:

1. An ergonomic support staff apparatus for supporting a user upon a surface comprising:

a longitudinally extended support member having upper and lower portions and an intermediate shaft portion extending therebetween; and, a grip handle member coupled to at least one of said upper and intermediate shaft portions of said support member, said grip handle member generally protruding from said support member, said grip handle member including an angled grip portion disposed in coplanar alignment with said support member to extend download in obliquely inclined manner relative thereto;

whereby the range of requisite arm swing motion for manipulation of said support member into stable engagement of the surface is minimized.

2. The ergonomic support staff apparatus as recited in claim 1 wherein said grip handle member is integrally formed with said support member.

3. The ergonomic support staff apparatus as recited in claim 1 wherein said grip handle member is adjustably coupled to said support member.

4. The ergonomic support staff apparatus as recited in claim 3 wherein said grip portion includes a proximate end pivotally coupled to said support member for angular adjustment in downward incline relative thereto.

5. An ergonomic support staff apparatus for supporting a user upon a surface comprising:

a longitudinally extended support member having upper and lower portions and an intermediate shaft portion extending therebetween; and a grip handle member coupled to at least one of said upper and intermediate shaft portions of said support member, said grip handle member generally protruding from said support member, said grip handle member including an angled grip portion disposed to extend in inclined manner relative to said support member;

wherein said grip handle member being adjustably coupled to said support member, said grip portion including a proximate end pivotally coupled to said support member for angular adjustment in downward incline relative thereto; and, wherein said grip handle member includes a lateral portion extending between a distal end of said grip portion and said support member, said lateral portion forming a slotted coupling with said support member for adjustable displacement relative thereto;

whereby the range of requisite arm swing motion for manipulation of said support member into stable engagement of the surface is minimized.

6. The ergonomic support staff apparatus as recited in claim 4 wherein said grip portion is pivotally displaceable within at least an approximate range of 33°–45° in angular offset from said intermediate portion.

7. The ergonomic support staff apparatus as recited in claim 1 wherein said support member is adjustable in length.

8. The ergonomic support staff apparatus as recited in claim 7 wherein at least a pair of said upper, lower, and intermediate shaft portions are telescopically coupled for selective relative displacement one relative to the other.

9. The ergonomic support staff apparatus as recited in claim 1 wherein said grip handle member includes a groove extending thereabout adjacent said grip portion, said grip portion having a plurality of finger grooves formed therein.

10. The ergonomic support staff apparatus as recited in claim 1 further comprising an auxiliary attachment releasably coupled to said support member.

11. The ergonomic support staff apparatus as recited in claim 10 wherein said auxiliary attachment includes a crutch extension projecting therefrom to configure said apparatus for use as a walking crutch.

12. The ergonomic support staff apparatus as recited in claim 11 wherein said crutch extension is coupled in angularly adjustable manner about said support member.

13. The ergonomic support staff apparatus as recited in claim 10 wherein said auxiliary attachment includes a handle extension pivotally displaceable between at least extended and folded positions relative to said support member.

14. The ergonomic support staff apparatus as recited in claim 1 wherein said lower portion of said support member terminates at a tip selected from the group consisting of: a gripping tip and a pointed ski pole tip.

15. An ergonomic support rod apparatus for supplemental support of a user upon a surface comprising:

a longitudinally extended support member having upper and lower portions and an intermediate shaft portion extending therebetween; and, a grip handle member adjustably coupled to said support member, said grip handle member protruding from said support member, said grip handle member including a selectively angled grip portion disposed in coplanar alignment with said support member to extend in downward obliquely inclined manner relative to said intermediate shaft portion;

whereby the range of requisite arm swing motion for manipulation of said support member into stable engagement of the surface is minimized.

16. The ergonomic support rod apparatus as recited in claim 15 wherein said support member is adjustable in length, at least a pair of said upper, lower, and intermediate shaft portions of said support member being telescopically coupled for selective relative displacement one relative to the other.

17. The ergonomic support rod apparatus as recited in claim 15 wherein said grip handle member is disposed to extend from said intermediate shaft portion of said support member.

18. The ergonomic support rod apparatus as recited in claim 17 further comprising an auxiliary attachment releasably coupled to upper portion of said support member, said auxiliary attachment including at least one of: a crutch extension having a curved part for cradling a portion of a user's arm, and a handle extension pivotally adjustable between at least extended and folded positions relative to said support member.

19. An ergonomic support staff apparatus for supplemental support of a user upon a ground surface comprising:

a longitudinally extended support member adjustable in length and having upper and lower portions and an intermediate shaft portion extending therebetween, at least a pair of said upper, lower, and intermediate shaft portions being telescopically coupled one to the other; and, a grip handle member coupled to said support member, said grip handle member protruding from said support member, said grip handle member including an angled grip portion disposed in coplanar alignment with said support member and extending in downward obliquely inclined manner relative thereto, said grip portion being angularly offset from said support member by a relative angle substantially within the approximate range of 33°–45°;

whereby the range of requisite arm swing motion for manipulation of said support member into stable engagement of the surface is minimized.

20. An ergonomic support staff apparatus for supplemental support of a user upon a ground surface comprising:

a longitudinally extended support member adjustable in length and having upper and lower portions and an intermediate shaft portion extending therebetween, at least a pair of said upper, lower, and intermediate shaft portions being telescopically coupled one to the other; and, a grip handle member coupled to said support member, said grip handle member protruding from said support member, said grip handle member including an angled grip portion extending in downwardly inclined manner relative thereto, said grip portion being angularly offset from said support member by a relative angle substantially within the approximate range of 33°–45°;

wherein:

said grip portion includes a proximate end pivotally coupled to said support member for angular adjustment in downward incline relative thereto; and, said grip handle member includes a lateral portion extending between a distal end of said grip portion and said support member, said lateral portion forming a slotted coupling with said support member for adjustable displacement relative thereto;

whereby the range of requisite arm swing motion for manipulation of said support member into stable engagement of the surface is minimized.

* * * * *